United States Patent [19]

DeArmas

[11] 4,362,080

[45] Dec. 7, 1982

[54] STACCATO COWBELL

[76] Inventor: Ramon O. DeArmas, P.O. Box 668702, Charlotte, N.C. 28208

[21] Appl. No.: 287,161

[22] Filed: Jul. 27, 1981

[51] Int. Cl.[3] ..... G10D 13/06

[52] U.S. Cl. ..... 84/406; 84/402; 116/170

[58] Field of Search ..... 84/402, 406, 407, 410; 116/148, 170

[56] References Cited

U.S. PATENT DOCUMENTS

| | | | |
|---|---|---|---|
| 72,422 | 12/1867 | Saxton | 116/170 |
| 451,740 | 5/1891 | Smith | 116/148 |
| 581,780 | 5/1897 | Shaaber | 116/149 |
| 870,025 | 11/1907 | Elsas | 84/406 |
| 1,088,482 | 2/1914 | Timmons | 84/403 |
| 1,324,263 | 12/1919 | Pappas | 116/170 |
| 3,893,363 | 7/1975 | Cohen | 84/402 |
| 3,896,696 | 7/1975 | Waters | 47/58 |

OTHER PUBLICATIONS

Latin Percussion advertisement for Mambo Cowbell.
Peripole, Inc. Advertisement, p. 6.

*Primary Examiner*—Lawrence R. Franklin
*Attorney, Agent, or Firm*—Bell, Seltzer, Park & Gibson

[57] ABSTRACT

This invention relates to a cowbell type of musical instrument with a plurality of sound producing ribs resonantly positioned on one side thereof to allow staccato sounds to be selectively produced intermittently during the play of the bell.

9 Claims, 5 Drawing Figures

STACCATO COWBELL

FIELD OF THE INVENTION

This invention relates to a musical instrument and, more particularly, relates to a cowbell type of musical instrument adapted to allow staccato sounds to be selectively produced intermittently during play of the bell.

BACKGROUND OF THE INVENTION

Cowbells as indicated by their name were originally hollow metal bell chambers attached singly or in numbers around a cow's neck to facilitate the locating of straying cows by tracing the sound of the bells. The particular hollow, echoing sound made by these bells was found to be pleasing by many and was further found to be complementary with the sounds of percussion oriented Latin American music. As a result, such cowbells without internal clappers became a relatively popular musical instrument, particularly in the playing of Latin American music and "steel band" calypso type music.

In such play musicians attempt to harmoniously blend in the bell sounds of the cowbell with the other percussion sounds of Latin American or calypso type music. However, even skilled musicians have difficulty properly interspersing the bell sounds of the cowbells with the accompanying drubbing sounds created in the play of such music. The result is too often a cacophony of such sounds as opposed to a smooth harmonious blending.

SUMMARY OF THE INVENTION

With the foregoing shortcomings and deficiencies in mind, it is an object of this invention to provide a cowbell type of musical instrument that is capable of being played to produce both bell sounds and drubbing staccato sounds in smooth succession.

Another object of this invention is to provide a cowbell type of musical instrument that lends itself to being easily played to produce bell sounds and staccato sounds selectively and intermittently.

Another object of this invention is to provide a cowbell type of musical instrument that is simple in construction, economical in manufacture, and otherwise well suited for the purpose for which it is designed.

BRIEF DESCRIPTION OF THE DRAWINGS

Some of the objects and feature of this invention having been stated, others will become more apparent as the description proceeds, when taken in connection with the accompanying drawings, in which.

DESCRIPTION OF THE ILLUSTRATED EMBODIMENTS

Figure 1:
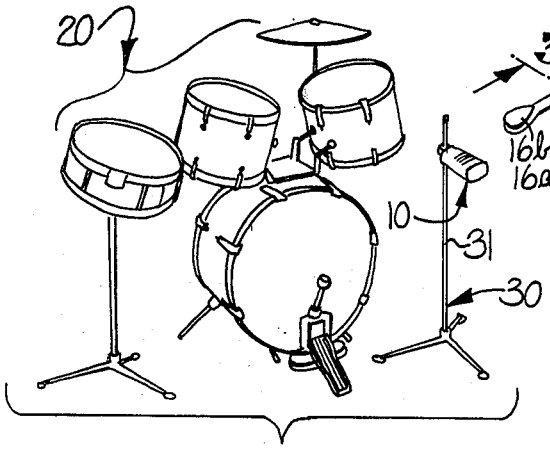
FIG. 1 is a perspective view in environmental setting illustrating the invention in a playing attitude along with accompanying percussion musical instruments.

Referring now to the drawings, which illustrates particular embodiments of the invention, FIG. 1 shows a cowbell type musical instrument 10 in accordance with the invention in environmental setting with other percussion musical instruments 20 arranged in its preferred orientation for play.

Figure 2:
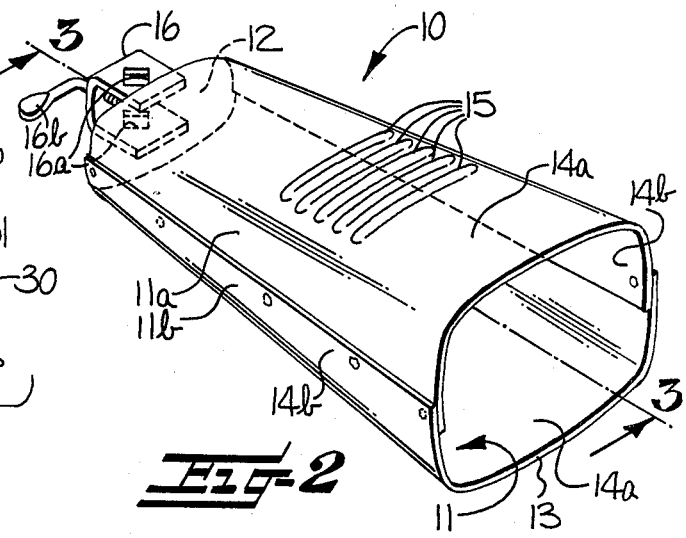
FIG. 2 is an enlarged perspective view of one embodiment of the invention.
Figure 3:
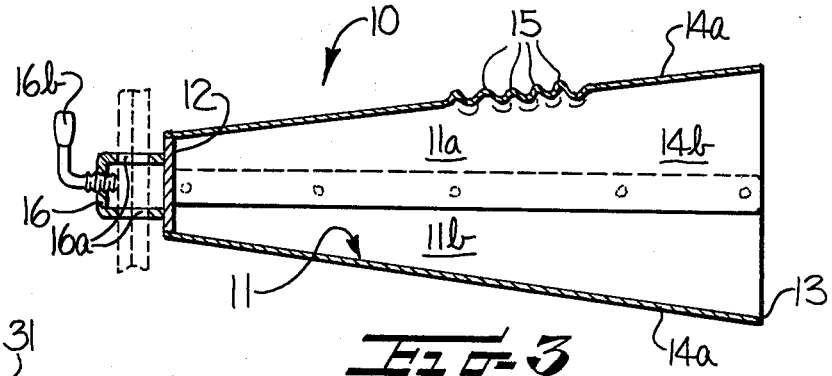
FIG. 3 is a sectional view along the line 3—3 of FIG. 2.

Referring specifically to FIGS. 2 and 3, the main body of the instrument 10 is a hollow rigid sounding chamber 11 typically made of metal or some other rigid resonant material. The chamber 11 has a closed smaller end 12 and an open larger end 13 and preferably four generally trapezoidal shaped sides extending from the closed end 12 to the open end 13. One pair of opposing sides **14*a* is larger than the other pair of smaller sides 14*b* with the sides and the intersections thereof being generally arcuate so that the chamber 11** is preferably generally oval in lateral cross-section.

Positioned adjacent to one side **14*a* of the sounding chamber 11 in resonant relation thereto are a plurality of generally parallel ribs 15. Preferably these ribs 15 protrude from the adjacent side 14*a* of the chamber 11** and are positioned transversely to said side and extend substantially the width thereof.

Figure 4:
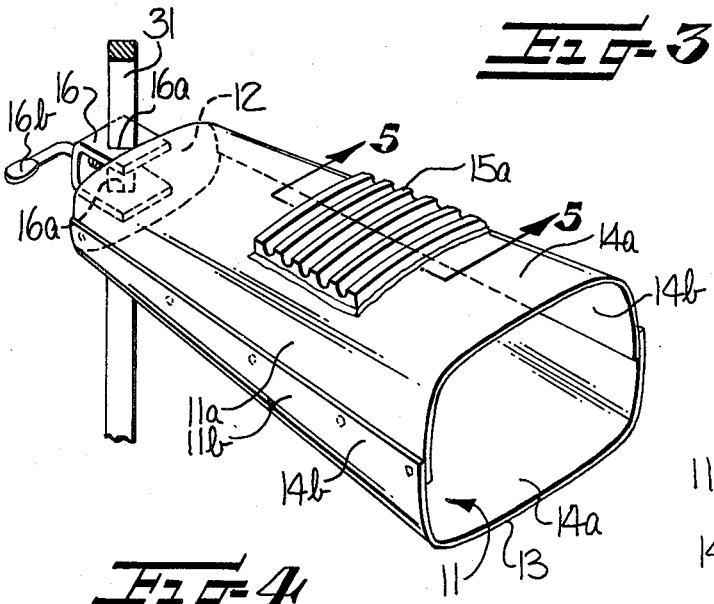
FIG. 4 is an enlarged perspective view similar to FIG. 2 but showing another embodiment of the invention.
Figure 5:
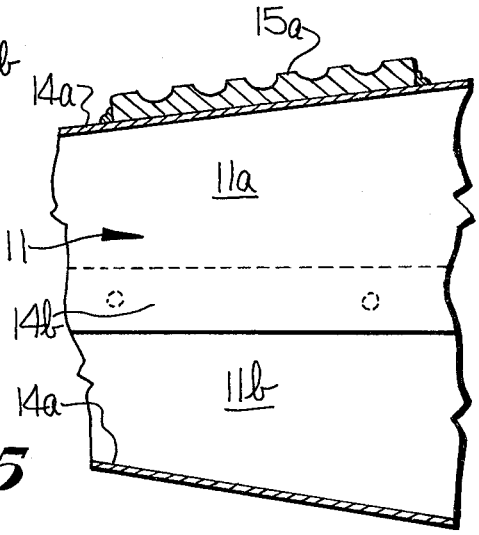
FIG. 5 is a sectional view along the line 5—5 of FIG. 4.

These ribs 15 may be pressed or stamped directly into the side **14*a* as shown in FIGS. 2 and 3 or may be formed as a separate integral unit 15*a* from suitable resonant material and then affixed to the side 14*a* of the chamber, as shown in FIGS. 4 and 5. In this latter form the under surface of the rib unit 15*a* should be generally arcuate so as to match the corresponding arcuate contour of the adjacent side 14*a*. The ribs 15 desirably are provided only at the medial portion of the adjacent side 14*a* of the sounding chamber 11** extending down said side only about one-quarter of the length of said side thereby leaving the end portions of said side free for usual play of the instrument.

Although the sounding chamber 11 may if desired, be formed from a single piece of material, for ease of construction it may be constructed as shown in FIGS. 2–5 with the sides of said chamber being constructed of two hemi-oval sections **11*a* and 11*b* joined together as by rivets or welding in overlapping arrangement with one another. In this form of construction, the smaller closed end 12 of the chamber comprises a separate generally oval section which is joined together to the side sections 11*a* and 11*b***.

Support attachment means in the form of a U-shaped bracket 16 is externally carried by the chamber 11 and preferably affixed to the smaller closed end 12 thereof for minimum interference with the sound producing function of the chamber 11. The U-shaped bracket 16 contains square-shaped openings **16*a* adapted to matingly receive a square-shaped vertical post 31 of a support stand 30. In securing the instrument 10, the post 31 is contacted by a set screw 16*b* which extends through the base of the U-shaped bracket 16 to secure the instrument 10 to the vertical post 31 of the support stand 30** at the desired predetermined height for playing.

In typical use the musical instrument 10 is played in conjunction with other percussion musical instruments 20, as shown in FIG. 1. Specifically, a single percussion musician will usually simultaneously and intermittently play a variety of percussion instruments such as drums, cymbals and bells employing one or more drumsticks in the play thereof. The instrument 10 of the invention is played by selectively intermittently striking the sounding chamber 11 portion of the instrument and the ribs 15. By so doing the single instrument 10 alternatively produces resonant bell sounds and staccato drubbing sounds depending upon how and when the bell and rib portions of the instrument 10 are alternatively struck and strummed, as by a drumstick during play of the instrument 10.

The various features of the invention facilitate such play and lead to the play being harmonious. As mentioned above, the parallel ribs 15 protrude and transversely extend substantially the width of the side 14*a* of the sounding chamber 11. This presents a readily accessible profile of the ribs 15 to be struck and played, particularly when the instrument 10 and stand 30 are positioned as shown in FIGS. 1–4 with the parallel ribs 15 oriented generally horizontally and facing upwardly. Also, the ribs 15 are preferably arranged in substantially equally spaced relation with one another so as to produce a regular staccato sound during their play independent of the direction in which the ribs are struck or how many particular ribs are struck during a strum motion. Furthermore, by providing such ribs 15 only at the medial portion of the sounding chamber, the adjacent end portions of the side 14*a* remain free for playing of bell sounds.

Although the parallel ribs 15 may be positioned on any of the sides 14*a* and 14*b* of the chamber 11, they preferably are positioned on only one of the larger sides 14*a*. By being positioned across the width of such larger side, a more accessible striking area is presented. And by having the ribs 15 positioned on only one side 14*a*, the adjacent and opposite sides all remain free for usual bell play if desired.

The presence of the ribs 15 enhances the sound of the instrument during play furthermore even when they are not struck by providing a mellowing effect to the play of the bell portions. Additionally, the play of the ribs and the sounds produced therefrom are enhanced by being resonantly positioned adjacent the chamber side 14*a*. The sound produced by strumming the ribs 15 is full and melodious because of the presence of the adjacent sounding chamber 11. This sound and its resonant nature also may be selectively altered and dampened by a alternatively contacting, as with the player's hand, certain of the sides of the chamber 11.

The instrument may be provided with chambers 11 of different sizes or shapes depending on the particular basic sound and tone desired. Also, the ribs 15 may be varied in size, number and location according to the final tonal effect desired. It is thus to be understood that the forms of the invention herein shown and described are to be taken as particular embodiments of the invention and that various changes in the shape, size and arrangement of parts thereof may be resorted to without departing from the spirit of the invention, or the scope of the authorized claims.

That which is claimed is:

1. A musical instrument, comprising a rigid sounding chamber, said sounding chamber being generally oval in lateral cross-section and having four generally trapezoidal shaped sides, said sounding chamber having an open larger end and a closed smaller end, support attachment means externally carried by said sounding chamber, a plurality of generally parallel ribs externally positioned in resonant relation to an adjacent side of said sounding chamber, said plurality of ribs being formed as an integral unit and being affixed to the adjacent side of the sounding chamber, said plurality of ribs adapted for successive striking as by a drumstick during play of the musical instrument whereby staccato sounds may be selectively intermittently produced during such play.

2. A musical instrument, comprising a rigid sounding chamber, said sounding chamber being generally oval in lateral cross-section and having four generally trapezoidal shaped sides with a pair of larger sides and a pair of smaller sides, said sounding chamber having an open larger end and a closed smaller end, support attachment means externally carried by said sounding chamber, a plurality of generally parallel ribs externally positioned in resonant relation adjacent a larger side of said sounding chamber and extending substantially the width of said larger side, said plurality of ribs further being positioned transversely to said side and protruding therefrom in substantially equally spaced relation with one another and thereby being adapted for successive striking as by a drumstick during play of the musical instrument whereby staccato sounds may be selectively intermittently produced during such play and wherein said plurality of ribs are provided only at the medial portion of said larger adjacent side of the sounding chamber thereby leaving the end portions of said side free for play of the instrument.

3. A musical instrument, comprising a rigid sounding chamber, said sounding chamber being generally oval in lateral cross-section and having four generally trapezoidal shaped sides, said sounding chamber having an open larger end and a closed smaller end, support attachment means externally carried by said sounding chamber, a plurality of generally parallel ribs externally positioned in resonant relation to an adjacent side of said sounding chamber, said plurality of ribs being positioned transversely to the adjacent side of the sounding chamber to facilitate their striking during play of the instrument, and being provided only at the medial portion of the adjacent side of the sounding chamber thereby leaving the end portions of said side free for play of the instrument, said plurality of ribs being adapted for successive striking as by a drumstick during play of the musical instrument whereby staccato sounds may be selectively intermittently produced during such play.

4. The musical instrument of claim 3 wherein said plurality of ribs protrude from the adjacent side of the sounding chamber to facilitate the play of the instrument.

5. The musical instrument of claim 4 wherein said plurality of protruding ribs are formed as an integral unit and are affixed to the adjacent side of the sounding chamber.

6. A musical instrument, comprising a rigid sounding chamber, said sounding chamber being generally oval in lateral cross-section and having four generally trapezoidal shaped sides with a pair of larger sides and a pair of smaller sides, said sounding chamber having an open larger end and a closed smaller end, support attachment means externally carried by said sounding chamber, a plurality of generally parallel ribs externally positioned in resonant relation adjacent a larger side of said sounding chamber and extending substantially the width of said larger side, said plurality of ribs being formed as an integral unit and being affixed to the adjacent larger side of the sounding chamber, and said plurality of ribs further being positioned transversely to said side and protruding therefrom in substantially equally spaced relation with one another and thereby being adapted for successive striking as by a drumstick during play of the musical instrument whereby staccato sounds may be selectively intermittently produced during such play.

7. The musical instrument of claim 6 wherein the sides of said sounding chamber are constructed of two hemi-oval shaped sections joined together in overlapping arrangement with one another.

8. The musical instrument of claim 6 wherein said plurality of ribs are provided only at the medial portion of said larger adjacent side of the sounding chamber thereby leaving the end portions of said side free for play of the instrument.

9. A musical instrument in combination with a vertical support therefor, said musical instrument comprising a rigid sounding chamber, said sounding chamber being generally oval in lateral cross-section and having four generally trapezoidal shaped sides with a pair of larger sides and a pair of smaller sides, said sounding chamber having an open larger end and a closed smaller end, support attachment means externally carried by said sounding chamber adjacent its closed end, a plurality of generally parallel ribs externally positioned in resonant relation adjacent a larger side of said sounding chamber and extending substantially the width of said larger side, said plurality of ribs being formed as an integral unit and being affixed to the adjacent larger side of the sounding chamber, said plurality of ribs further being positioned transversely to said side and protruding therefrom in substantially equally spaced relation from one another, said musical instrument being attached to said vertical support and at a predetermined height and being positioned with its parallel ribs oriented generally horizontally and facing upwardly to facilitate their successive striking as by a drumstick during play of the musical instrument whereby staccato sounds may be selectively intermittently produced during such play.

* * * * *